United States Patent [19]

Sheriff

[11] Patent Number: 4,940,991

[45] Date of Patent: Jul. 10, 1990

[54] DISCONTINUOUS MOBILE ANTENNA

[76] Inventor: Jack W. Sheriff, 2167 Calle Guaymas, La Jolla, Calif. 92037

[21] Appl. No.: 294,186

[22] Filed: Jan. 9, 1989

Related U.S. Application Data

[63] Continuation-in-part of Ser. No. 179,788, Apr. 11, 1988, abandoned, and a continuation-in-part of Ser. No. 211,893, Jun. 27, 1988.

[51] Int. Cl.[5] ..... H01Q 9/28

[52] U.S. Cl. ..... 343/795; 343/807; 343/872; 343/897

[58] Field of Search ..... 343/795, 828, 829, 846, 343/897, 899, 792.5, 872, 807, 905, 792

[56] References Cited

U.S. PATENT DOCUMENTS

| | | | |
|---|---|---|---|
| 2,163,471 | 6/1939 | Sharp | 343/713 |
| 2,480,155 | 8/1949 | Masters | 343/795 |
| 2,656,463 | 10/1953 | Woodward | 343/795 |
| 2,673,931 | 3/1954 | Stevens | 343/795 |
| 2,945,227 | 7/1960 | Broussaud | 343/731 |
| 3,036,302 | 5/1962 | Hudoch | 343/767 |
| 3,050,730 | 8/1962 | Lamberty | 343/792.5 |
| 3,079,602 | 2/1963 | Du Hamel et al. | 343/792.5 |
| 3,290,688 | 12/1966 | Kraus | 343/897 |
| 4,084,162 | 4/1978 | Dubost et al. | 343/700 MS |
| 4,317,121 | 1/1982 | Campbell | 343/790 |
| 4,728,962 | 3/1988 | Kitsuda et al. | 343/872 |

FOREIGN PATENT DOCUMENTS

| | | | |
|---|---|---|---|
| 129485 | 3/1945 | Australia | 343/897 |
| 565660 | 11/1958 | Canada | 343/795 |
| 1301376 | 8/1969 | Fed. Rep. of Germany | 343/830 |

OTHER PUBLICATIONS

Van Nostrand's Scientific Encyclopedia, Fourth Edition 1968, p. 537.

Standard Handbook for Electrical Engineers, Tenth Edition, 1968, pp. 25–137, by Fink and Carroll.

Transmission Lines Antennas and Wave Guides, First Edition, 1945, pp. 130, 133, 144–149, by King, Mimno and Wing.

"Reference Data for Radio Engineers", Fourth Edition, 1956, pp. 662–665.

"Micro-Strip Antenna's", Second Edition, 1982, p. 27, by Bahl and Bhartia.

"Flat, Flexible TV Antenna Offers High Gain", by Marshall K. Kessie, Electronics Design 6, vol. 23, Mar. 15, 1975.

*Primary Examiner*—Rolf Hille

*Assistant Examiner*—Michael C. Wimer

*Attorney, Agent, or Firm*—Henri J. A. Charmasson

[57] ABSTRACT

A discontinuous panel shaped element forms one of the radiating dipole members of a radio frequency mobile antenna fed by a coaxial cable. The discontinuous element decouples antenna currents in the coaxial cable placed at short to medium distances from the element, while maintaining matched element performance as a long distance transmitter. The radiating elements are surrounded by an insulating material which serves as a dielectric, further improving antenna performance and also serving as environmental protection. The radiating elements are made from readily available sheet stock materials aligned in a generally planar configuration. The discontinuous dipole member is attached to the shield and the other dipole member is connected to the center lead of the coaxial cable. A small section of the central cable conductor is stripped of insulation and shielding, to serve as a miniature loading coil for loading the first plate-type conductive element. The specific geometries tested produce antenna performance that is generally insensitive to dielectric variations of as much as 25%.

11 Claims, 2 Drawing Sheets

DISCONTINUOUS MOBILE ANTENNA

PRIOR APPLICATION

This application is a continuation in part of a co-pending application Ser. No. 07/179,788, filed on Apr. 11, 1988, now abandoned and co-pending application Ser. No. 07/211,893, filed on Jun. 27, 1988.

FIELD OF THE INVENTION

This invention relates to antennas, more specifically to dipole antennas within housings.

BACKGROUND OF THE INVENTION

Antennas for mobile or portable use should be small, light weight, rugged in construction, pleasing in appearance and low in cost. However, more importantly, the antenna must be able to perform as a receiver and/or transmitter of radio frequency signals within the mobile environment and within mobile power source limitations at a high omnidirectional gain.

Typical mobile transceivers currently employ quarter-wave whip antennas (see: *Standard Handbook for Electrical Engineers,* Tenth Edition, by Donald G. Fink and John M. Carroll, editors, McGraw-Hill, 1968, New York, page 25–74). A fairly uniform omnidirectional vertical polarity pattern is obtained from such installations. However, these antennas require significant space, distance from other conductive materials, specific position with respect to the environment and are usually placed above a horizontal plane.

Various other antenna techniques and structures are also known. These include employing conducting and non-conductive portions of the mobile structure (see for example: U.S. Pat. Nos. 4,317,121; 4,160,977; 4,117,490; 3,961,330; and 3,916,413); bonding the antenna structure to the non-conductive portions of the mobile structure (see for example U.S. Pat. Nos. 4,331,961; and 3,646,561); embedding the antenna or caged antenna in the mobile structure (see for example: U.S. Pat. No. 3,717,876) and reducing the dimensions to a small fraction of the wavelength. These approaches typically require added nonconductive material, typically air, as a dielectric to insulate the conductive antenna elements. A final approach is to use a dipole element for the conductive portions.

The use of dipole elements in an antenna can be as simple as a straight radiator fed in the center to produce currents with two nodes, one at each of the far ends of the radiator (see *Van Nostrand's Scientific Encyclopedia,* Fourth Edition, D. Van Nostrand Company, Princeton, N.J. 1968, Page 537). Analysis of the field intensity of these elementary dipole antennas is segregated into short distance (less than 0.01 wavelengths), intermediate (0.01 to 5.0 wavelengths) and great distance (greater than 5 wavelengths), see *Reference Data for Radio Engineers,* Fourth Edition, Published by International Telephone and Telegraph Corporation, New York, 1956, pages 662–665. The two nodes are typically insulated from each other (except at the central point/area of connection) by air. In order to improve tuning and balance, various geometries are used. Two separate radiator elements can also be used. Variations with two separate radiator elements include slots, altering sizes of nodes, folded radiators and adding/altering the dielectric between the elements (see the section on Slot Antennas, specifically the relationship to metallic dipole antennas, supra, pages 687–689, and U.S. Pat. No. 3,210,766).

Small sizes of antenna are particularly desirable for mobile application, as space and wind resistance consideration may be critical. Patch or microstrip antennas have been developed for this application (see *Micro-Strip Antennas,* 2nd Edition by Bahl & Bhartia, published by Artech House, at Ottawa, Canada, 1982, Page 27). These typically provide a first element (top hat) and second element (ground plane) which sandwich a dielectric material, feed by a coaxial cable. This type of antenna is currently used for cellular communicatIons over the 822–890 MHZ frequency band. This approach produces a very small package, but with limitations.

Limitations of these patch antennas are primarily related to the narrow band of performance and the poor gain produced within that narrow band. Typical gains are in the order of zero to negative 2 Dbd from a standard dipole reference over the same band of frequencies. Frequency band for these "gains" is typically limited to the order of 40 MHZ (less than the entire bandwidth from 822 to 890 MHZ). Other limitations include the sensitivity to other dielectrics proximate to the radiating elements in the environment and exposure of the (conductive) elements, requiring additional protection from shorting or damage.

An additional limitation is related to the unbalance caused by the coaxial cable coupling with respect to the radiating elements, and the unsymmetrical geometry of the coupling and elements of these antennas (see *Transmission Lines Antennas and Wave Guides,* First Edition, by Ronald W. P. King, Harry Rowe Mimno, and Alexander H. Wing, Published by McGraw-Hill Book Company, 1945, Pages 130–133, 145–149). A coaxial line parallel and feeding the radiating antenna elements can have stray antenna currents, that is currents excited by one of the radiating antenna elements. In a metal shield of a coaxial cable, antenna currents may be primarily on the outer surface of the shield or outer conductor. At high frequencies this can cause the coaxial line to act as as a three conductor (outer and inner surface currents on the outer conductor as well as transmission currents on the inner conductor).

Matched, but perforated radiating elements are also known. However, orientation and geometries of the coaxial cable, impedance sections and the matched porous radiating antenna sections can lead to still further problems and/or unwanted and/or stray antenna currents. Prior art concentrated on the geometry and spacing of the two matched perforated radiating elements elements to minimize problems with unwanted antenna currents in the coaxial cable. Examples of various geometries for matched radiating elements are shown in U.S. Pat. Nos. 2,673,931 (multiple equal elements), 3,036,302 (balanced doublets), and 2,480,155 (matched grid shaped).

Unmatched radiating elements are also known. Although these may reduce stray antenna currents, performance may be severely compromised. An example of unmatched radiating element design is shown in U.S. Pat. No. 2,945,227 (plane and helix elements).

SUMMARY OF THE INVENTION

The principal and secondary objects of the invention are:

To provide a smaller, more rugged mobile antenna especially suited to cellular bandwidths;

To provide an antenna with improved bandwidth and gain performance without the prior art geometry limitations; and To provide an antenna less susceptible to environmental damage or impacts on performance.

These and other objects are achieved by providing discontinuous or perforated panel shaped structure for one of the matched radiating members proximate to the coaxial cable. The discontinuous or perforated structure tends to decouple antenna currents in the coaxial cable at short distances, while the generally matched overall radiator geometry maintains performance at long distances. The radiating elements are surrounded by an insulating material which serves as a dielectric, further improving antenna performance and also serving as environmental protection. The conductive elements are readily available mesh and sheet stock materials aligned in a generally planar configuration attached to a coaxial cable. A small section of the central cable conductor is stripped of insulation and shielding, to serve as a miniature loading coil for the quarter wave top section loading of the first sheet conductive element. Shielding of the coaxial cable is attached directly to a second conductive element made from a discontinuous material, serving as the counterpoise. The specific geometries tested produce antenna performance generally insensitive to dielectric variations of as much as 25%.

DESCRIPTION OF THE PREFERRED EMBODIMENT

Figure 1:
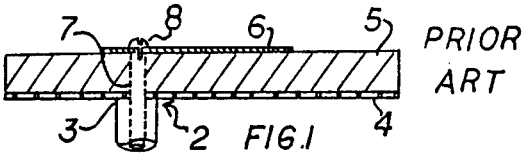
FIG. 1 shows a prior art implementation shows a side cross sectional view of a prior art patch antenna.

FIG. 1 shows a top view of a prior art patch or microstrip antenna. Coaxial cable 2 connects the antenna to a generator (not shown for clarity) which supplies the signal to be transmitted. Shielding 3 of the cable 2 is attached to a plate or ground plane 4. Ground plane 4 is one pole of the dipole antenna and is composed of a conductive sheet which sandwiches insulator slab 5 on one side. Partially covering the other side of insulator 5 is the second pole of the dipole antenna or active plate or top hat 6. The second pole or plate 6 is connected to the center conductor 7 (shown dotted for clarity) of coaxial cable 2 by screw 8, which also holds the assembly together. Bonding plates 4 and 6 to insulator 5 is an alternate assembly technique. The thickness of insulator 5 and dimensions of plates 4 and 6 are chosen to maximize performance over the frequencies of interest.

Figure 2:
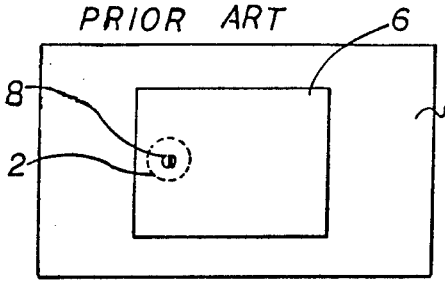
FIG. 2 shows a top view of the prior art patch antenna.

FIG. 2 shows a top view of the conductive element of a prior art mobile antenna. Insulator slab 5 is partially covered by active plate 6. Screw 8 attaches active plate 6 to the center conductor of coaxial cable 2 (shown dotted for clarity). Environmental protection from shorting active plate 6 is optional and is not shown.

Figure 3:
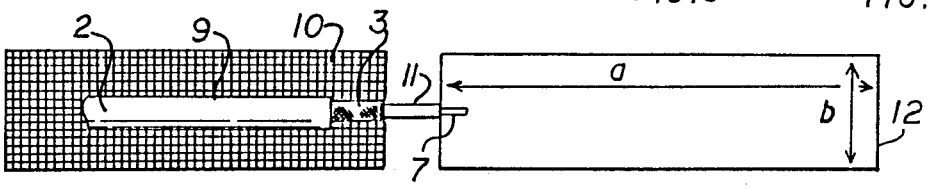
FIG. 3 shows a top view of the conductive elements of a mobile antenna embodiment.

FIG. 3 shows a top view of the conductive elements of a preferred embodiment of a mobile antenna. Coaxial cable 2 again supplies the radio frequency signal to be transmitted from a generator or other radio communications device (not shown for clarity). Outer insulating jacket 9 is stripped from cable 2 to expose conductive shielding or outer conductor 3. Shielding 3 is conductively attached to first active or conductive mesh element 10, also known as counterpoise plane. A discontinuous mesh-type conductive element 10 is panel shaped and radiatively matched (but not necessarily equal) to plate 12, which is similar to ground plane 4 of FIG. 1. Because of the perforated (mesh) construction, the orientation/proximity with respect to the cable and active element does not induce significant stray antenna currents. The perforated mesh-type element 10 does not have to be a flat or parallelepiped element as shown, that is it may be concave, have multiple surface curvature, or have trapezoidal or curved edges. The first conductive element also does not have to be a woven construction, but may consist of multiple perforations, surface dimples, distortions, notches, overlapping ports or other discontinuous construction of the radiating element. The preferred embodiment of the first conductive, but discontinuous element 10 is a planar section of multiple brass wires, woven into a 40×40 mesh, that is 40 openings between wires per 2.54 cm (1 inch) distance in a first direction and 40 openings per 2.54 (1 inch) distance in a direction perpendicular to the first direction.

Coaxial insulator 11 surrounds the center conductor 7 of coaxial cable 2 for a short distance between the first or counterpoise element 10 and second conductive planar or active plate element 12, to serve as a connector and/or loading coil (inductance). An alternate configuration would have the coaxial insulator 11 removed over this short distance, as this would not impact radiative performance, but presence of insulator prevents the accidental contact of shielding 3 and conductor 7, or the accidental contact of center conductor 7 to mesh-type element 10. The center conductor is conductively attached to the second panel-shaped conductive element 12 which is located adjacent to, but not adjoining counterpoise panel 10. The distance is selected to configure the short unshielded center conductor to act as a loading coil for matching the impedance in order to maximize performance.

The second panel-shaped element 12 does not necessarily have to be the shape of a parallelepiped as shown. The shape may be concave or have multiple surface or edge curves, but shape must have a predominant radiating surface for the radio frequency signals in conjunction with or matched to the first conductive element 10. The preferred embodiment is composed of brass shim stock sheeting, cut to specific dimensions which maximize performance of the antenna within a container envelope. Thickness (not shown in this Figure, in the plane of the paper) is in the range of 0.13 to 0.25 mm (0.005 to 0.010 inches). In the preferred embodiment shown, the overall dimensions a and b of the second element 12 are generally matched to the mesh element 10. First dimension a in the preferred embodiment is 6.4 cm (2.5 inches), and second dimension b is 1.9 cm (0.75 inch). Other configurations can vary the dimensions and geometric shapes of the first and second active elements to match envelope limitations, and the directional, frequency, and performance objectives. Alternate embodiments of the second panel-shaped element could substitute a second perforated element, a concave/convex shaped elements, or an irregular, but generally panel-shaped element.

The specific dimensions shown were obtained by experimentation to fit within the dielectric container (shown in FIG. 7) and supplied with radio signals in the frequency band of 822 to 890 MHZ through a coaxial cable. The dimensions of the preferred embodiment gave the maximum performance in these experiments within the aforementioned constraints.

Figure 4:
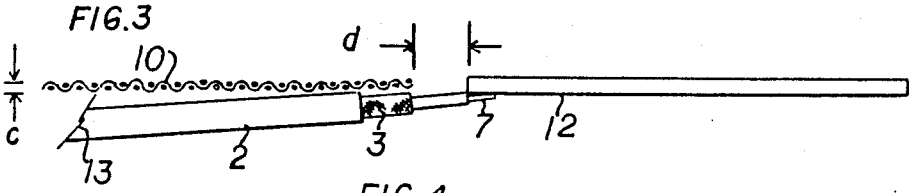
FIG. 4 shows a side view of the assembled conductive elements of the antenna.

FIG. 4 shows a side view of the embodiment shown in FIG. 3. Coaxial cable 2 supplies the signal to be transmitted (the signal generator is not shown for clarity) to supply point 13. Shielding 3 is tin soldered or otherwise electrically connected to the discontinuous mesh element 10. Plate thickness c of first mesh-type element 10 and second active element 12 has been tested in the range from 0.13 to 0.25 mm (0.005 to 0.010 inch) in this configuration, but plate thickness is not expected to be critical if significantly less than major dimensions a and b (see FIG. 3). Dimension d is the separation between the first and second conductive elements In testing, the optimum dimension d was found to be comparable to the diameter of the coaxial cable of 0.64 cm (0.25). Center conductor 7 is tin soldered or otherwise electrically connected to the solid or continuous element 12.

Figures 5, 6:
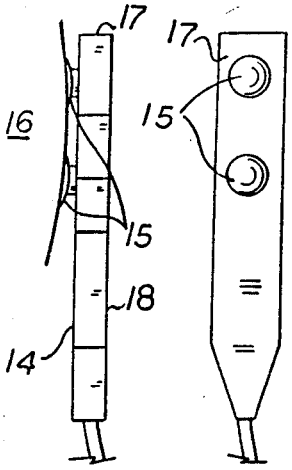
FIG. 5 shows a side view of the assembled mobile antenna.
FIG. 6 shows a top view of the assembled mobile antenna.

FIG. 5 is a side view of the assembled mobile antenna with the conductive or radiating elements within a dielectric container 14. Container 14 completely surrounds the conductive elements shown in FIG. 3, except for a feedthrough of the coaxial cable 2 leading to the radio signal generator (not shown for clarity). Two suction cups 15 are provided as a convenient means to attach the assembled antenna to a portion of vehicle 16. Vehicle 16 portion in the preferred embodiment is a glass window. This allows a 360 degree field for the antenna. The configuration will also function well if vehicle portion 21 is another nonconductive element, such as plastic body components. Container 14 can be formed from two half container sections, a lower suction section 17 and a cover section 18. Half sections can snap together or be adhesively bonded. Material of construction is selected as having a dielectric strength greater than air and sufficient structural strength and flexibility to protect the conductive elements. A plastic with a dielectric strength of 2.5 at 1 GHZ was used for the preferred embodiment, but testing with dielectric strengths varying from this value by 25 percent also showed acceptable performance. The container sections 17 and 18 are also ribbed for added strength, with the ribs contacting the conductive plates at the edges. Remainder of the containers were within approximately 0.32 cm (⅛ inch) of the conductive surface area. The thin plate and mesh materials of construction also allowed deformation of the container during handling without damage.

FIG. 6 shows a top view of the container 14. Suction section 17 contains the two suction cups 15 which provide attachment to the vehicle (not shown in this view for clarity).

Figure 7:
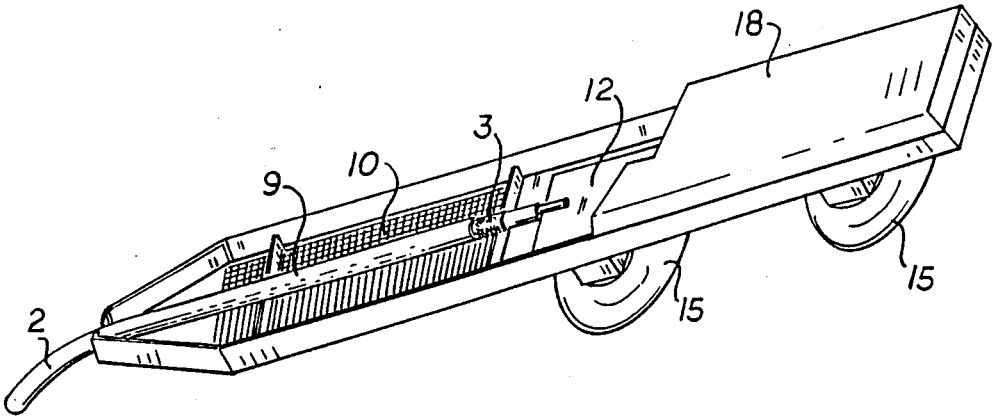
FIG. 7 shows a perspective partially sectioned view of an assembled mobile antenna.

FIG. 7 shows a perspective partially sectioned view of an assembled mobile antenna. Cover section 18 has been partially sectioned to expose the interior of the lower suction section 17 (see FIG. 6). Cable 2 is passed though a port (having a dimension comparable to the diameter of the cable 2) in the container to the interior where it passes over the first mesh-type element 10 to the edge proximate to the second element 12. Outer jacket 9 is removed and shield 3 is attached to the first mesh-type element 10 at this point. Unshielded center conductor continues and is attached to the nearest edge of second conductive plate-type element 12, which is partially obscured in this view. Suction cups 15 again provide a convenient means for removably attaching the mobile antenna to a vehicle (not shown for clarity) Although both conductive elements 10 and 12 are mounted on a common non-conductive material (container), another configuration (not shown) provides a separate non-conductive material that both conductive elements are mounted on prior to insertion into the container, allowing ease of assembly of mounted elements into the container.

While the geometry of the preferred embodiment has been described, many other embodiments and geometries are possible. The mesh element 10 could essentially replace the base element hat 5 of FIGS. 1 and 2. The conductive elements of FIGS. 1 and 2 (with mesh replacing base element 4) could also be placed within a dielectric container similar to container 14 shown in FIG. 5 except shaped to conform to the external dimensions of the conductive elements.

Figure 8:
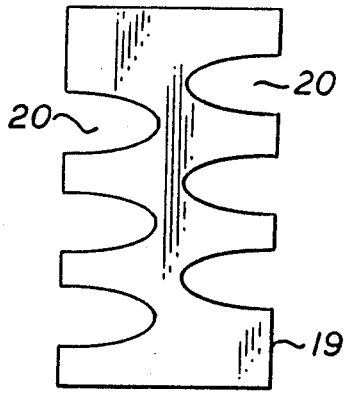
FIG. 8 shows a top view of an alternate perforated element.

FIG. 8 shows an alternate embodiment of a first alternate perforated element 19. The alternate element 19 is shaped to generally match the second conductive element 12 (see FIG. 3), but avoid presenting a continuous surface having a dimension equal to a fraction (or integer multiple) of the signal wavelengths being transmitted or received. In this embodiment, a series of deep and overlapping notches 20 in one or more of the edges of the element 19 provide the perforations needed to be discontinuous and avoid stray antenna currents in the proximate (generally within a short or intermediate distance from) coaxial cable (see FIG. 3). The notches 20 may have an irregular surface or be placed asymmetrically to further avoid stray currents.

Figure 9:
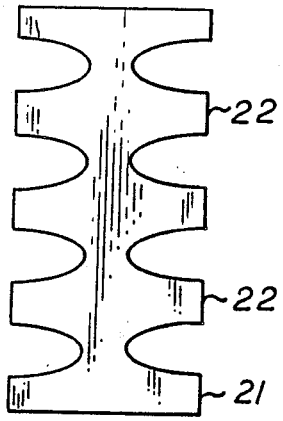
FIG. 9 shows a top view of a second alternate perforated element.

FIG. 9 shows a top view of a second alternate perforated element 21. In this embodiment, a branch like structure of the plate type of element provides the perforated configuration. This configuration, the central stem and short branch 22 structure provides added strength, while providing perforations between the branches 22.

Figure 10:
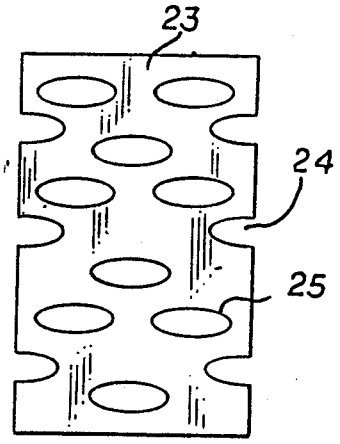
FIG. 10 shows a top view of a third alternate perforated element.

FIG. 10 shows a top view of a third alternate perforated element 23. In this configuration, smaller saw like notches 24 on one or more of the edges are combined with ports or cutouts 25 to provide the perforated configuration. The ports and notches provide overlapping perforations in the plate 23.

Figure 11:
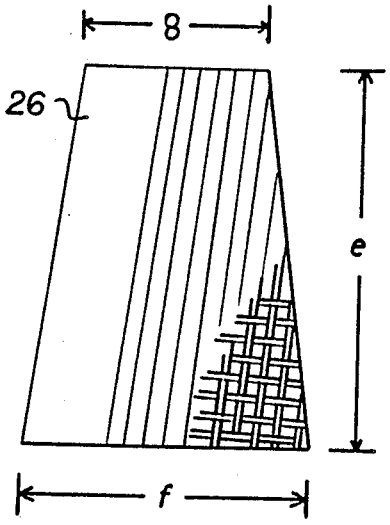
FIG. 11 shows a top view of a fourth alternate perforated element.

FIG. 11 shows a top view of a fourth alternate perforated element 26. In this configuration, a mesh, similar to that shown in FIG. 3 is again used to provide a perforated structure, but the geometry and orientation of the mesh has been altered to further decouple stray antenna currents. The key dimension "e" match the comparable dimensions "a" (as shown in FIG. 3), while dimensions "f" and "g" generally match dimension "b" as shown in FIG. 3. The orientation of the mesh structure of the plate 26 is such that wires are not parallel or perpendicular to the edge of dimension "g" attached to one of the cable conductors as shown in FIG. 3.

While the preferred embodiment of the invention has been shown and described, as well as some other embodiments, changes and modifications may be made therein within the scope of the appended claims without departing from the spirit and scope of this invention.

What is claimed is:

1. An antenna connectable to a radio communication device which consists of:

a first conductive panel-shaped, generally oblong element;

a second conductive panel-shaped, generally oblong element having a different geometry;

said elements being aligned in a same plane along their largest axes and defining a gap between two respective adjacent edges of said elements;

a coaxial cable, connectable at a distal end to the communication device and having a proximal end section running parallel to said largest axes along said first element and terminating within said gap;

a first conductor in the center of said cable being connected at said proximal end to the edge of the second element adjacent to the first element;

a second conductor of said cable forming a sleeve around said first conductor and being connected at said proximal end to the edge of the first element adjacent to the second element;

said first element having a discontinuous construction;

an oblong container completely enclosing said conductive elements and said end section of the cable, said container being made of a dielectric material having a dielectric strength greater than air.

2. The antenna as claimed in claim 1, wherein said second conductive element is a made of brass shim stock material having a thickness ranging from 0.13 mm to 0.25 mm and a maximum dimension of less than 6.5 cm.

3. The antenna as claimed in claim 2, wherein said first conductive element is made of brass shim stock material having perforations and notches along one edge, and a thickness ranging from 0.13 mm to 0.25 mm and a maximum dimension at least equal to said maximum dimension of said second planar element.

4. The antenna as claimed in claim 3, wherein the distance between said adjacent edges is generally equal to the external diameter of said coaxial cable within one order of magnitude.

5. The antenna as claimed in claim 4, wherein said perforated element and said second conductive element have generally symmetrical external shapes.

6. The antenna as claimed in claim 5, wherein said conductive elements are generally spaced with 0.32 cm of said dielectric material of said container.

7. The antenna as claimed in claim 6, wherein said diameter of said coaxial cable is approximately 0.64 cm.

8. The antenna as claimed in claim 1, wherein said discontinuous element is a mesh-type structure in a parallelepiped shape made of brass wire approximately 0.0254 cm in diameter woven in a 40×40 mesh, having 40 openings per 2.54 cm vertically, 40 openings per 2.54 cm horizontally.

9. The antenna as claimed in claim 1, wherein said discontinuous first conductive element is a planar shape having a notched edge, wherein said notched edge forms a structural shape having a plurality of branches.

10. The antenna as claimed in claim 1, wherein said discontinuous first element is a planar shape having a saw toothed edge.

11. The antenna as claimed in claim 9, wherein said notched element also comprises interior perforations.

* * * * *